US006733408B2

(12) United States Patent
Reed

(10) Patent No.: US 6,733,408 B2
(45) Date of Patent: May 11, 2004

(54) BELT TENSION/DRIVE FOR PINCH ROLLER SYSTEM

(75) Inventor: Charles W. Reed, Wabash, IN (US)

(73) Assignee: Martin Yale Industries, Inc., Wabash, IN (US)

( * ) Notice: Subject to any disclaimer, the term of this patent is extended or adjusted under 35 U.S.C. 154(b) by 0 days.

(21) Appl. No.: 10/115,784

(22) Filed: Apr. 4, 2002

(65) Prior Publication Data

US 2003/0190987 A1 Oct. 9, 2003

(51) Int. Cl.[7] ..... F16H 7/22
(52) U.S. Cl. ..... 474/101; 493/441
(58) Field of Search ..... 474/100, 101, 474/148; 493/422, 441; 74/63

(56) References Cited

U.S. PATENT DOCUMENTS 5,012,260 A * 4/1991 Yoshimura et al. ..... 346/139 R
5,624,366 A * 4/1997 Beeri ..... 493/23
6,183,406 B1 * 2/2001 Barrus et al. ..... 493/320
6,478,066 B1 * 11/2002 Rossi et al. ..... 156/472
6,501,934 B1 * 12/2002 Ahuja et al. ..... 399/307

* cited by examiner

*Primary Examiner*—Thomas R. Hannon
*Assistant Examiner*—Vicky A. Johnson
(74) *Attorney, Agent, or Firm*—Cardinal Law Group

(57) ABSTRACT

The belt tension/drive for a pinch roller system of the present invention combines means for urging a plurality of pinch rollers toward a capstan roller with means for driving pinch rollers when a pinch roller is not in contact with the capstan roller. The capstan roller is surrounded by and aligned with a plurality of pinch rollers. A resilient belt disposed about the plurality of pinch rollers urges the pinch rollers toward the capstan roller and drives any pinch roller not in contact with the capstan roller, assuring that all pinch rollers maintain the same surface speed as the capstan roller.

20 Claims, 5 Drawing Sheets

BELT TENSION/DRIVE FOR PINCH ROLLER SYSTEM

TECHNICAL FIELD

The technical field of this disclosure is belt driven power transfer devices, particularly, a belt tension/drive for a pinch roller system.

BACKGROUND OF THE INVENTION

Pinch roller systems are used with machines that handle sheets of material, such as a paper folder. Paper folders are able to take sheets of paper or other material and fold them into various patterns for stuffing in envelopes or mass mailings. To accomplish the folding, the paper folder feeds paper between a pinch roller and a capstan roller. The paper path is blocked, so that the travel of the paper is stopped and the paper buckles. A second path is provided where the buckles occurs, so the blocked paper follows the second path. As the paper travels into this second path, it is grabbed by a second pinch roller and the original capstan roller, which creases the paper at the point of buckling, and drives the paper through any remaining fold processes. The blocking, grabbing, and creasing process can be repeated to form multiple folds.

The pinch rollers must be urged toward the capstan roller, while having sufficient freedom of movement to allow for single and multiple sheets of paper of various weights to pass between the pinch rollers and the capstan roller. It is very important that all of the rollers continually driver the paper through the folder. Large degrees of paper slippage cannot be tolerated, as this will cause a bad fold and/or a paper jam. Therefore, not only do the pinch rollers have to be urged toward the capstan roller, they must all be driven simultaneously at the same surface speed. Pinch roller systems typically provide separate means to perform the functions of urging the pinch rollers toward the capstan roller and driving the pinch rollers.

FIGS. 1 & 2 show the use of springs to urge the pinch rollers toward the capstan roller. The bearings and bushings used to support and guide the pinch rollers and capstan roller have been omitted from the figures for clarity. FIG. 1 shows a schematic diagram of a Single Spring Method in which a tension spring 20 is wrapped around pinch rollers 22 to urge the pinch rollers 22 toward capstan roller 24. FIG. 2 shows a schematic diagram of a Multi-Spring Method in which each pinch roller 30 is urged toward capstan roller 32 by a compression spring 34. Each of the pinch rollers 30 has a compression spring 34, increasing cost and complexity. Both the Single Spring Method and the Multi-Spring Method provide the force to urge the pinch rollers toward the capstan roller while providing sufficient freedom of movement to allow for different material thickness between the pinch rollers and the capstan roller, but require separate means to drive the pinch rollers.

FIGS. 3 & 4 show the use of gears and cogged belts to drive the pinch rollers at a simultaneous surface speed. The bearings and bushings used to support and guide the pinch rollers and capstan roller have been omitted from the figures for clarity.

FIG. 3 shows a schematic diagram of Gear Driven Pinch Rollers in which a capstan roller gear 40 attached to a capstan roller (not shown) drives pinch roller gears 42 attached to a pinch roller (not shown). Gears are designed to operate at a specific distance from one another. The point where gears make contact is commonly known as the pitch diameter. The pitch diameter for the capstan roller gear 40 and the pinch roller gears 42 must be the same as their respective roller diameters or there will be a difference in surface speeds between the capstan roller and the pinch roller. Surface speed difference causes binding and lock-up conditions. Because of gear design restrictions, there are limited options for capstan and pinch roller design.

Although the capstan roller gear 40 and the pinch roller gears 42 contact each other at the pitch diameter, a certain amount of play, also called backlash, occurs. Because the capstan roller and pinch roller move away from each other as paper passes between them, the point of contact of the associated gears moves away from the pitch diameter. This increases backlash, causing premature wear, which increases the chance that a gear could slip a tooth and cause a bad fold or paper jam.

FIG. 4 shows a schematic diagram of Cogged Belt Driven Pinch Rollers in which a cogged belt 50 is wrapped around pinch roller sprockets 52 attached to a pinch roller (not shown). Because the pinch rollers are in contact with the capstan roller, the capstan roller 54 turns the pinch roller, which turns the pinch roller sprockets 52. The teeth of the cogged belt 50 are engaged with the teeth of the pinch roller sprockets 52. To maintain the tooth alignment, the cogged belt 50 must be stiff with very little stretch or compliance. Because the capstan roller and pinch roller move away from each other as paper passes between them, the cogged belt 50 cannot be pulled tight to the pinch roller sprockets 52, but must have a certain amount of slack to allow the pinch rollers to move. The slack causes play between the teeth of the cogged belt 50 and the teeth of the pinch roller sprockets 52. Too much play can cause premature wear and slippage of the pinch rollers.

Both the Gear Driven Pinch Rollers and Cogged Belt Driven Pinch Rollers provide the means to drive the pinch rollers at the same surface speed, but require separate means to urge the pinch rollers toward the capstan roller. This increases the cost and complexity of the system. The changing distance between the capstan roller and pinch roller as paper passes between them causes tooth alignment problems and premature wear.

It would be desirable to have a belt tension/drive for a pinch roller system that would overcome the above disadvantages.

SUMMARY OF THE INVENTION

One aspect of the present invention provides a belt tension/drive for a pinch roller system which combines the tension and drive functions.

Another aspect of the present invention provides a belt tension/drive for a pinch roller system at lower cost and with less complexity.

Another aspect of the present invention provides a belt tension/drive for a pinch roller system avoiding premature wear that could cause operating and maintenance problems.

Another aspect of the present invention provides a belt tension/drive for a pinch roller system avoiding the use of gears and springs.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DESCRIPTION OF THE PREFERRED EMBODIMENT

The belt tension/drive for a pinch roller system of the present invention combines means for urging a plurality of pinch rollers toward a capstan roller with means for driving pinch rollers when a pinch roller is not in contact with the capstan roller. The capstan roller is surrounded by and aligned with a plurality of pinch rollers. A resilient belt disposed about the plurality of pinch rollers urges the pinch rollers toward the capstan roller and drives any pinch roller not in contact with the capstan roller, assuring that all pinch rollers maintain the same surface speed as the capstan roller.

Figure 1:
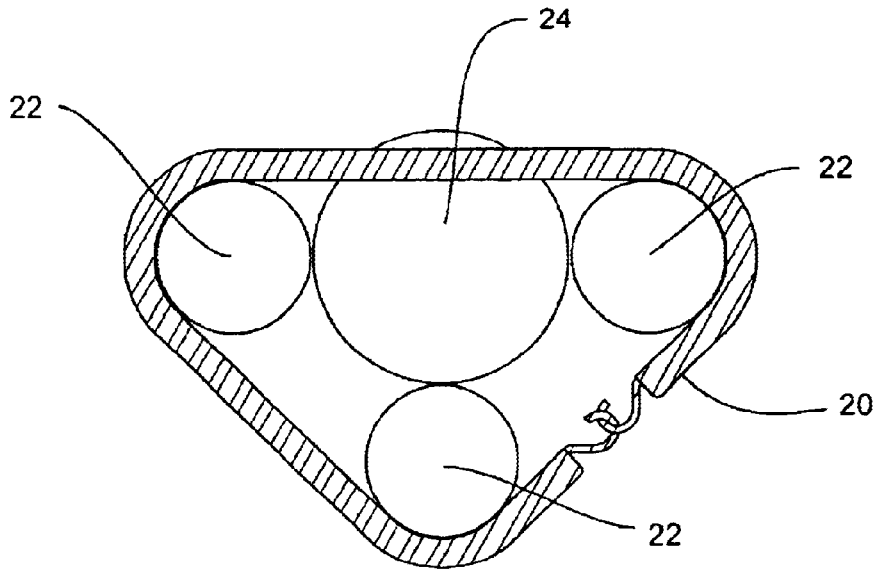
FIG. 1 (PRIOR ART)
FIG. 1 shows a schematic diagram of a Single Spring Method.
Figure 2:
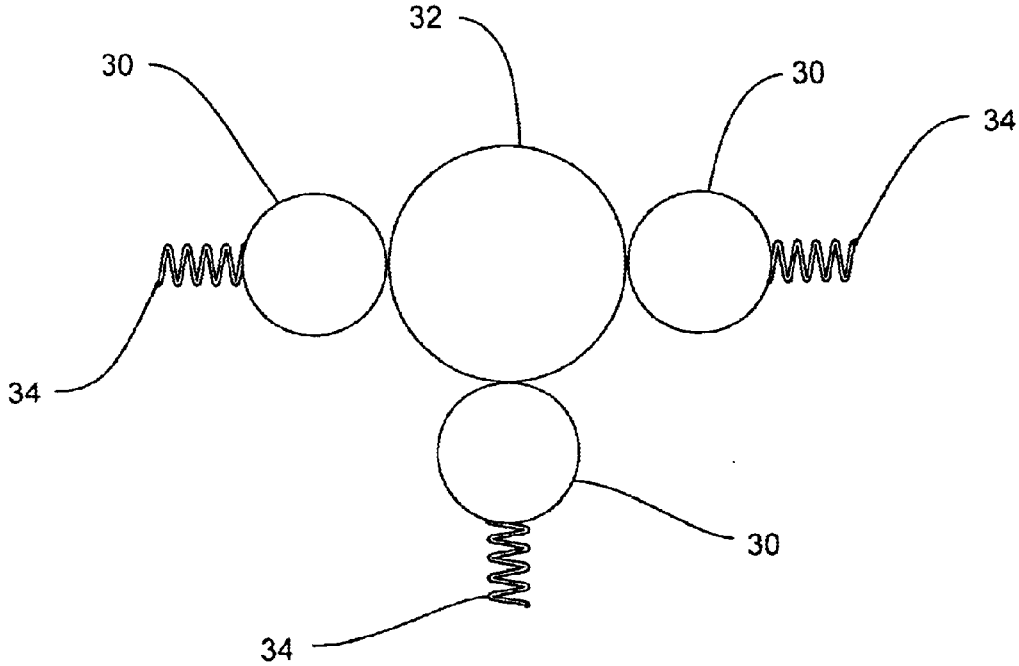
FIG. 2 (PRIOR ART)
FIG. 2 shows a schematic diagram of a Multi-Spring Method.
Figure 3:
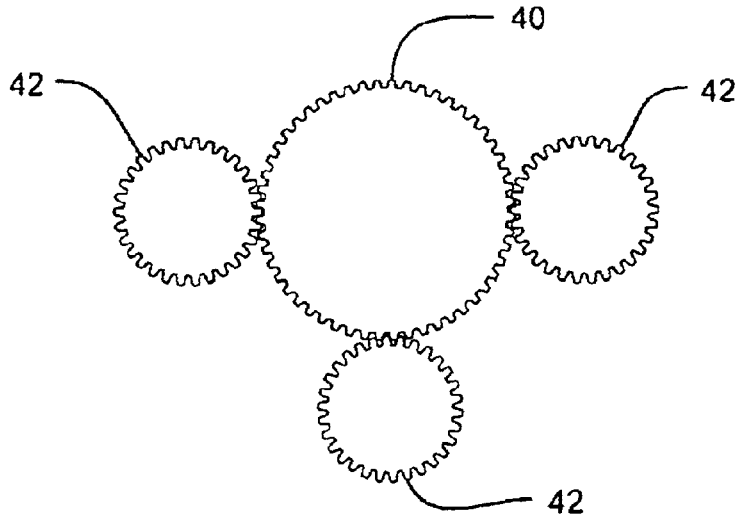
FIG. 3 (PRIOR ART)
FIG. 3 shows a schematic diagram of Gear Driven Pinch Rollers.
Figure 4:
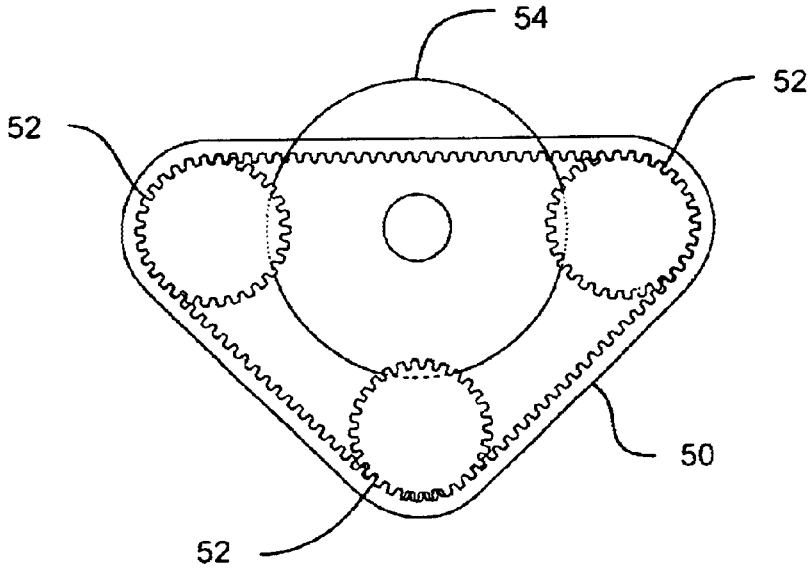
FIG. 4 (PRIOR ART)
FIG. 4 shows a schematic diagram of Cogged Belt Driven Pinch Rollers.
Figure 5:
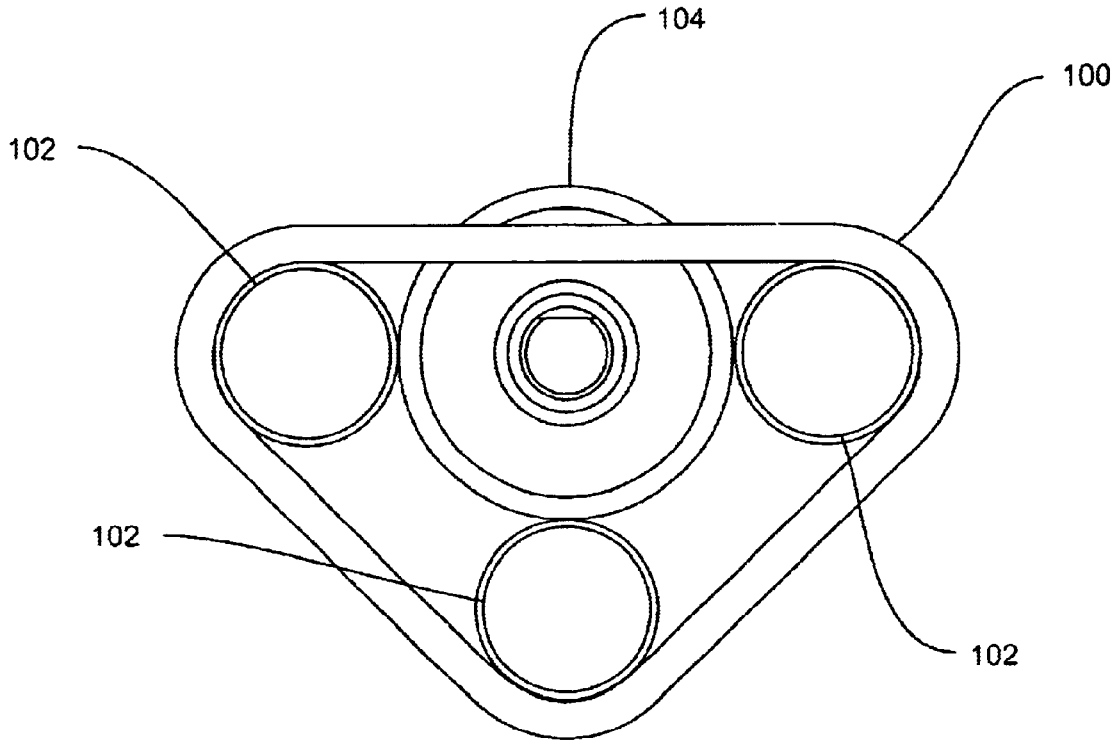
FIG. 5 shows a schematic diagram of a belt tension/drive for a pinch roller system made in accordance with the present invention.

FIG. 5 shows schematic diagram of a belt tension/drive for a pinch roller system made in accordance with the present invention. The bearings and bushings used to support and guide the pinch rollers and capstan roller have been omitted from the figures for clarity. A resilient belt 100 wraps around a plurality of pinch rollers 102, urging the plurality of pinch rollers 102 toward capstan roller 104. The frictional contact between the pinch rollers 102 and the capstan roller 104 drives the pinch rollers 102 to rotate when the capstan roller 104 rotates. When one of the pinch rollers 102 is not in contact with the capstan roller 104 because paper is passing between the pinch roller 102 and the capstan roller 104 and displaces the pinch roller 102, the displaced pinch roller 102 continues to be driven at the same surface speed by the travel of the belt 100 driven by the pinch rollers 102 which remain in contact with the capstan roller 104.

The resilient belt 100 both provides pressure to the pinch rollers 102 as required to hold the pinch rollers 102 in contact with the capstan roller 104 and provides a means by which drive energy can be of transferred to one or more pinch rollers not in contact with the capstan roller 104. The resilient belt 100 can be made of any resilient, compliant material with sufficient elasticity to urge the pinch rollers 102 toward the capstan roller 104 while allowing the pinch roller 102 to move when paper is present between the pinch roller 102 and the capstan roller 104. In addition, the resilient belt 100 can have a large enough friction coefficient or sticky surface to transmit the driving force from one pinch roller to the other without substantial slippage. In one embodiment, the resilient belt 100 can be made of a polymer, such as polyurethane, although those skilled in the art will recognize that other materials are suitable for the application. Typically, the resilient belt 100 can have a durometer hardness of about 85A, but can be in the range between about 20A and 110A. A lower durometer reading, indicating a softer, more pliable polymer, is desirable for use with thicker sheets or a greater number of sheets, so the pinch rollers 102 can move away from the capstan roller 104 more easily. With proper material selection, the portion of the pinch roller 102 where the resilient belt 100 rides can be fabricated without any special treatment or surface finish and still provide good frictional contact.

The capstan roller 104 provides the drive power to rotate the pinch rollers 102 and drive the resilient belt 100 through the pinch rollers 102. The capstan roller 104 can be made of any material with a sufficiently high coefficient of friction to drive the pinch rollers 102. In one embodiment, the capstan roller 104 can be made of a polymer, such as a rubber-like material. As the capstan roller 104 spins, contact between at least one pinch roller and the capstan roller 104 will transfer rotational energy to the belt, which drives the pinch rollers that are not in direct contact with the capstan roller 104. The capstan roller 104 can be driven directly by an electric motor or other driving means, or indirectly with the electric motor or other driving means driving belts or gears which drive the capstan roller 104.

The pinch rollers 102 are normally in contact with the capstan roller 104, except when sheets of paper or other material are fed between the pinch roller 102 and the capstan roller 104. Because drive energy cannot be transferred reliably to the pinch roller 102 by the sheet material, the pinch roller 102 that is separated from the capstan roller 104 by the sheets is driven through the resilient belt 100 by the pinch rollers 102 that are still in contact with the capstan roller 104. The pinch rollers 102 can be made of any material that is relatively strong with a sufficiently high coefficient of friction to be driven by capstan roller 104 and to be driven by and drive the resilient belt 100. Typically, the pinch rollers 102 can have a hard, slick surface. In one embodiment, the pinch rollers 102 can be made of metal and have a uniform diameter along its length, such as a length of ground shafting. Although the example shows a pinch roller system having three pinch rollers, the pinch roller system can have two pinch rollers or more than three pinch rollers as desired for a particular application.

Figure 6:
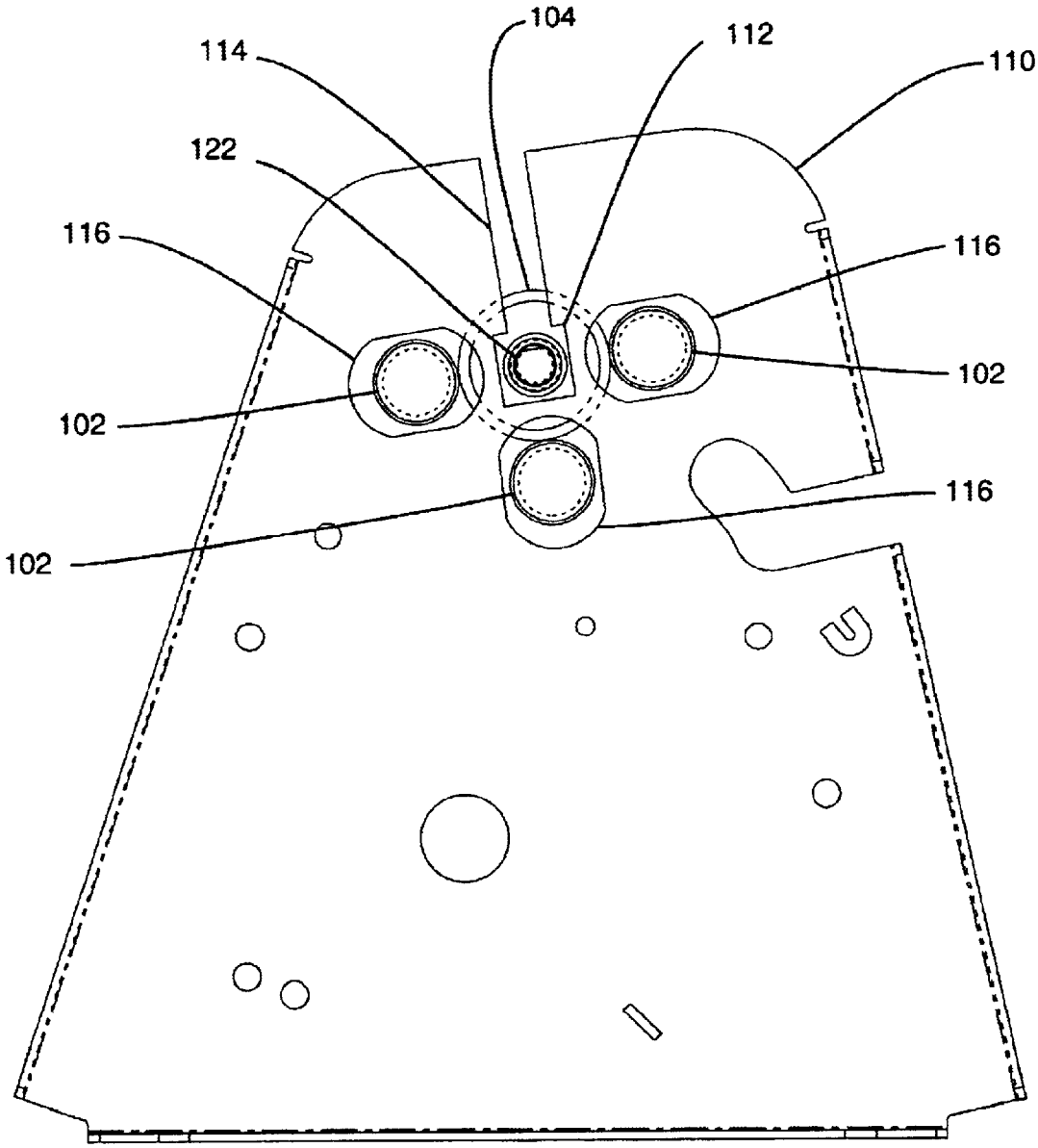
FIG. 6 shows a diagram of a frame for a belt tension/drive for a pinch roller system made in accordance with the present invention.

FIG. 6, in which like elements have like reference numbers with FIG. 5, shows a schematic diagram of a frame for a belt tension/drive for a pinch roller system made in accordance with the present invention. The capstan roller bushing and pinch roller bushings (120 and 118, respectively, on FIG. 7) have been omitted for clarity. The frame 110 has a capstan roller bushing hole 112 and a plurality of pinch roller slots 116. In an alternate embodiment, the capstan roller bushing hole can be combined with one of the pinch roller slots. The pinch roller slots 116 slidably support pinch roller bushings, which support the pinch rollers. The capstan roller slot 114 above the capstan roller bushing hole 112 allows the capstan roller bushing and the capstan roller 104 to be moved into position during assembly. The capstan roller bushing hole 112 supports the capstan roller bushing, which fixedly supports the capstan roller shaft 122 relative to the frame 110.

Figure 7:
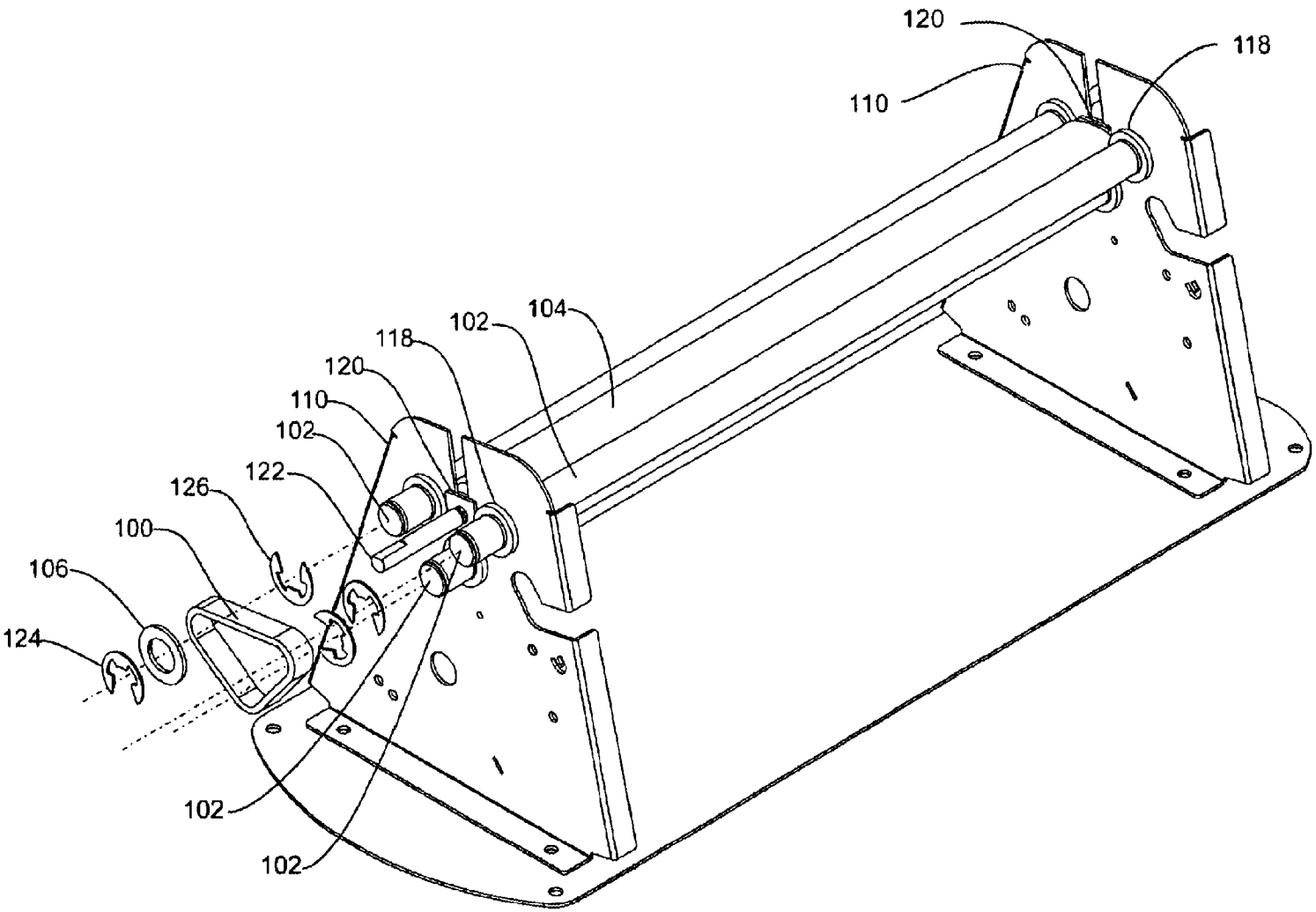
FIG. 7 shows an exploded view of a belt tension/drive for a pinch roller system made in accordance with the present invention.

FIG. 7, in which like elements have like reference numbers with FIGS. 5 & 6, shows an exploded view of a belt tension/drive for a pinch roller system made in accordance with the present invention. Frame 110 supports a plurality of pinch rollers 102 through pinch roller bushings 118 and supports a capstan roller 104 through capstan roller bushing 120. The pinch roller bushings 118 can be allowed to move in the frame 110 relative to the capstan roller 104. The pinch roller bushings 118 can have flat bottomed grooves formed on each surface where the pinch roller bushing meets the pinch roller slot 116, so that pinch roller bushings 118 are able to slide along the pinch roller slots 116 when the paper moves the pinch roller relative to the capstan roller. The pinch roller bushings 118 and capstan roller bushing 120 can be made of any material allowing rotation of the respective rollers without undue friction or wear. In one embodiment, the pinch roller bushings 118 can be made of bronze and the capstan roller bushing 120 made of nylon, such as Zytel® brand nylon made by DuPont.

Capstan roller shaft 122 extends the axis of the capstan roller 104 to provide an attachment to drive the capstan roller 104. Resilient belt 100 is disposed about the plurality of pinch rollers 102 and urges them toward the capstan roller 104. In one embodiment, outer snap ring 124 can be used on one of the plurality of pinch rollers 102 to hold the resilient belt 100 on the plurality of pinch rollers 102. Inner snap rings 126 disposed on the pinch rollers 102 maintain the axial position of the pinch rollers 102. The snap rings can grip the surface of the pinch roller 102 without the need for a machined groove, although a groove can be used to provide additional holding power if desired. In another embodiment, outer snap rings can be installed one or more of the plurality of pinch rollers 102. A washer 106 between the snap ring 124 and the belt 100 prevents unnecessary wearing of the belt 100 by the snap ring 124.

Duplicate belt tension/drives can be provided on both ends of the pinch rollers, i.e., one resilient belt can be wrapped around one end of the pinch rollers and another belt can be wrapped around the opposite end. Use of the same belt tension/drive arrangement on both ends assures that the pinch rollers remain parallel to the capstan roller as sheets pass between the pinch rollers and the capstan roller, avoiding sheet slippage, misfeeds, and jams.

It is important to note that FIGS. 5–7 illustrate specific applications and embodiments of the present invention, and is not intended to limit the scope of the present disclosure or claims to that which is presented therein. For example, the resilient belt could be installed inboard of the frame, rather than outside of the frame as shown. Extra washers can be used to provide greater longevity. The resilient belt material could be neoprene or a similar material. Pinch roller bearings can be made from nylon, turkite, bronze, Celcon® acetal copolymer made by Celenese AG, Delrin® acetal copolymer made by DuPont, Zytel® nylon made by DuPont, or similar materials. Upon reading the specification and reviewing the drawings hereof, it will become immediately obvious to those skilled in the art that myriad other embodiments of the present invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A belt tension/drive assembly for a pinch roller system comprising:

a capstan roller, the capstan roller having a rotational axis;

a plurality of pinch rollers, the pinch rollers having a rotational axis, the rotational axis of the pinch rollers aligned parallel to the rotational axis of the capstan roller; and a resilient belt disposed about the plurality of pinch rollers, the resilient belt urging the plurality of pinch rollers toward the capstan roller, and the resilient belt rotationally connecting the plurality of pinch rollers.

2. The belt tension/drive assembly of claim 1 wherein the plurality of pinch rollers is three pinch rollers.

3. The belt tension/drive assembly of claim 1 wherein the resilient belt is made of a polymer.

4. The belt tension/drive assembly of claim 3 wherein the resilient belt is made of polyurethane.

5. The belt tension/drive assembly of claim 1 further comprising:

a frame, the frame having a plurality of pinch roller slots; and pinch roller bushings, the pinch roller bushings disposed within the pinch roller slots;

wherein the pinch roller bushings support the pinch rollers.

6. The belt tension/drive assembly of claim 5 wherein the pinch roller slots slidably support the pinch roller bushings.

7. The belt tension/drive assembly of claim 1 wherein the surface of the capstan roller is a rubber-like material.

8. The belt tension/drive assembly of claim 1 wherein the pinch rollers are of uniform cross-section.

9. The belt tension/drive assembly of claim 1 further comprising at least one snap ring disposed adjacent to the resilient belt on at least one of the plurality of pinch rollers.

10. A belt tension/drive system for a pinch roller system for handling sheet material comprising:

means for advancing the sheet material;

means for pinching the sheet material into the sheet advancing means; and means for simultaneously urging the pinching means toward the sheet advancing means and driving the pinching means.

11. The belt tension/drive system of claim 10 further comprising means for slidably supporting the pinching means.

12. The system of claim 10 further comprising means for retaining the urging and driving means on the pinching means.

13. A belt tension/drive assembly for a pinch roller system comprising:

a first frame and a second frame, each frame having a plurality of pinch roller slots and a capstan roller slot;

a plurality of pinch roller bushings, each pinch roller bushing slidably disposed in one of the pinch roller slots;

a first capstan roller bushing, the first capstan roller bushing disposed in the capstan roller slot of the first frame;

a second capstan roller bushing, the second capstan roller bushing disposed in the capstan roller slot of the second frame;

a plurality of pinch rollers, each pinch roller having a first end and a second end, the first end of each pinch roller disposed in the pinch roller bushing of the first frame and the second end of each pinch roller disposed in the pinch roller bushing of the second frame;

a capstan roller, the capstan roller having a first end and a second end, the first end of the capstan roller disposed in the capstan roller bushing of the first frame and the second end of the capstan roller disposed in the capstan roller bushing of the second frame;

at least one resilient belt disposed about the plurality of pinch rollers, the resilient belt urging the plurality of pinch rollers toward the capstan roller, and the resilient belt rotationally connecting the plurality of pinch rollers.

14. The belt tension/drive assembly of claim 13 wherein the plurality of pinch rollers is three pinch rollers.

15. The belt tension/drive assembly of claim 13 wherein the resilient belt is made of a polymer.

16. The belt tension/drive assembly of claim 15 wherein the resilient belt is made of polyurethane.

17. The belt tension/drive assembly of claim 13 wherein the surface of the capstan roller is a rubber-like material.

18. The belt tension/drive assembly of claim 13 wherein the pinch rollers are of uniform cross-section.

19. The belt tension/drive assembly of claim 13 further comprising at least one snap ring disposed adjacent to the resilient belt on the at least one of the plurality of pinch rollers.

20. The belt tension/drive assembly of claim 13 wherein the first capstan roller bushing and second capstan roller bushing are made of nylon, and the pinch roller bushings are made of bronze.

* * * * *